US006055501A

United States Patent [19]

MacCaughelty

[11] Patent Number: 6,055,501

[45] Date of Patent: Apr. 25, 2000

[54] COUNTER HOMEOSTASIS OSCILLATION PERTURBATION SIGNALS (CHOPS) DETECTION

[76] Inventor: Robert J. MacCaughelty, 3801 Country Ridge Rd., Charlotte, N.C. 28226

[21] Appl. No.: 09/108,926

[22] Filed: Jul. 1, 1998

Related U.S. Application Data

[60] Provisional application No. 60/051,712, Jul. 3, 1997.

[51] Int. Cl.[7] ..... G10L 9/00

[52] U.S. Cl. ..... 704/272; 704/276

[58] Field of Search ..... 704/200, 270, 704/272, 273, 274, 201

[56] References Cited

U.S. PATENT DOCUMENTS

| | | | |
|---|---|---|---|
| 3,971,034 | 7/1976 | Bell, Jr. et al. | 346/33 R |
| 4,143,648 | 3/1979 | Cohen et al. | 128/731 |
| 4,490,840 | 12/1984 | Jones | 704/276 |
| 4,900,256 | 2/1990 | Dara-Abrams | 434/236 |
| 4,932,416 | 6/1990 | Rosenfeld | 128/731 |
| 5,113,870 | 5/1992 | Rossenfeld | 128/731 |
| 5,450,855 | 9/1995 | Rosenfeld | 128/732 |
| 5,546,943 | 8/1996 | Gould | 128/653.1 |
| 5,562,453 | 10/1996 | Wen | 434/185 |
| 5,647,834 | 7/1997 | Ron | 600/23 |
| 5,794,203 | 8/1998 | Kehoe | 704/271 |

*Primary Examiner*—Richemond Dorvil

*Attorney, Agent, or Firm*—Dougherty & Associates

[57] ABSTRACT

A method and apparatus for detecting counter homeostasis oscillation perturbation signals (CHOPS) found within the wave form of human speech that reflects either arousal in the autonomic nervous system or other biological processes. The apparatus is a speech analysis system for obtaining biofeedback information from human speech samples having variable duration. The speech analysis system comprises means for digitizing the human speech samples, storage means for receiving the digitized speech samples from the digitizing means and storing the digitized speech samples, processing means for detecting and analyzing CHOPS in the digitized speech samples and display means for presenting the analyzed speech samples in a visual representation. The speech analysis system may further include transducer means for collecting and transducing human speech samples into electrical signals and input means for configuring the analysis parameters of the processing means. The present invention does not require any electrode or probe attachment from the speech analysis system to a subject. The method provides biofeedback from physiological indicators of stress using the speech analysis system. The method includes recording a human speech sample having variable duration with the transducer means, digitizing the human speech sample with the means for digitizing, storing the digitized speech sample in the storage means, determining CHOPS in the digitized speech sample with the processing means based on pre-determined parameters and identifying relationships between the CHOPS in the digitized speech sample with the processing means.

14 Claims, 3 Drawing Sheets

COUNTER HOMEOSTASIS OSCILLATION PERTURBATION SIGNALS (CHOPS) DETECTION

CROSS-REFERENCE TO RELATED APPLICATION

This application claims the benefit of U.S. Provisional Application No. 60/051,712, filed Jul. 3, 1997.

FIELD OF THE INVENTION

The present invention relates to measurement and analysis of the variability in levels of psychological stress in people and, more particularly, to physiological indicators of psychological stress and biofeedback and the detection of the same.

BACKGROUND OF THE INVENTION

Physiological indicators of psychological stress and biofeedback are employed by virtually all health care disciplines, spanning such diverse areas as psychology, psychophysiology, psychiatry and many subspecialties of medicine, dentistry and the behavioral sciences. Psychological stress is a part of healthy human growth yet is implicated in many physical and mental disorders. What may overwhelm the resources in one person may be within the resources of another person who is capable of coping with such stress. What may distress one person may be an exciting challenge to another. What may be within one person's capacities, in a particular situation and moment, may overstrain another person.

Psychological stress is conceptually defined as a state of psychological strain, from external or internal sources, which imposes demands or adjustments upon an individual that are appraised by the individual as being excessive to available resources and endangering the individual's personal well-being such that some breakdown of organized functioning occurs. One common way of measuring psychological stress is through physiological indicators. A primary class of such indicators is the psychophysiological responses of the autonomic nervous system (ANS). In general, measurements of end organ responses are used as physiological indicators. For example, commonly measured physiological indicators include the electrical activity of the skin, heart rate, heart rate variability, blood pressure, blood volume pulse, finger temperature, respiration, muscle tension, is brain wave activity and the like.

The current, most common modalities of biofeedback instruments monitor the measurement of muscle tension, skin temperature, electrical properties of the skin, respiration, heart rate related measurements and various brain wave activities. Many modalities for measuring psychological stress, including the aforementioned common modalities, involve devices that reflect either arousal in the ANS or arousal in other biological processes.

The measurement of the sound in a human speech sample is another physiological indicator measured by biofeedback and psychological stress instruments. Sound in the human voice is initially a product of the vibration of vocal "cords" or folds in the larynx. Vocal fold vibrations result from partially closing the glottis so that air is forced through the glottis by contraction of the lung cavity.

The term vocal "cords" is imprecise. In actuality, vocal "cords" consist of lips or folds of muscle, the thyroarytenoid and an elastic ligament placed symmetrically to the left and right of the median line of the larynx. The vocal folds are attached at one end to an inner projection of two small cartilages, the arytenoids, and at the other end to the front angle of the thyroid cartilage, or more commonly known as the Adam's apple. A system of muscles enable the cartilages to glide, pivot or seesaw. The term "glottis" is defined as the generally triangular space enclosed by the two vocal folds by their connection to the thyroid cartilage. The glottis can be closed by the muscular movement of the arytenoid cartilages which bring the vocal folds together. During normal respiration and also during the articulation of voiceless consonants, such as p, f, t and k, the glottis is open. Consonants that are pure noises without the periodic resonant, musical sounds of vowels are termed "voiceless consonants." Consonants that are a combination of noise and laryngeal tones are termed "voiced consonants", such as b, v, voiced s (z), etc.

When the glottis is completely opened, the glottis is ready to begin vibrating, provided that tension of the thyroarytenoid muscle is not required for a particular register. Contrary to former belief, this tension is not essentially produced by the stretching of the vocal folds, but rather by an internal muscular contraction. The rate of vocal fold vibration or the fundamental frequency of the voice depends on a number of factors including the sex and age of the speaker, the speaker's intonations and, in particular, on the vocal fold length, size, mass and tension. For example, the vocal folds are thick for a low register and, for higher registers, the vocal folds are thin and shaped more or less like a ribbon. Additionally, a portion of the vocal fold, instead of the entire vocal fold, may vibrate. The vibrating body or vocal fold is thus correspondingly shortened in length to produce higher tones. The rate of vibrations of the vocal folds varies between 60 to 70 cycles per second (Hz) for the lowest male voices with an upper limit of 1200 to 1300 cycles per second (Hz) for the soprano voices. The average rate of vibration is from 100 to 150 Hz for a man and from 200 to 300 Hz for a woman.

Vocal fold vibrations are modified by the effect of resonance of the vibrations throughout various cavities in the chest and head. Resonance is a phenomenon in which sound vibrations or waves tend to set in motion elastic bodies that are in the path of the sound waves. For example, if the particular resonating frequency of the body in the path of the sound wave is the same as that for the sound wave, the body begins to vibrate. Vocal fold vibrations are typically modified by resonance in the chest, throat, mouth (including the area formed by projection and rounding of the lips), nose and sinus cavities. By moving the tongue and jaw, the cavity of the mouth can change almost endlessly in shape and volume to result in variations in the resonance of vocal fold vibrations. The great mobility of the lips further contributes to the resonance of the mouth cavity.

Voiced sound signals have complex frequencies that are based on the various resonance frequencies of the relevant cavities and harmonic or overtone, whole-number multiples of the basic fundamental frequencies of the sound signals. Resonating overtones are termed "formant sound" and appear in distinct frequency bands corresponding to each of the particular cavities. The first, or lowest frequency, formant is created by the resonance in the mouth and throat cavities and is noted for frequent frequency shifts as the mouth changes dimensions and volume during the formation of various sounds, particularly vowel sounds. The highest frequency formant involves resonance in the nose and sinus cavities and is more constant than formant sound in the lower frequency bands because such cavities tend to have more constant volumes and shapes than the mouth. Resonant voiced sounds are characterized by these formants. For example, most vowels are recognized by the sound of the first two formants together, but vowels sound fuller when the first three formants are heard. The higher fourth, fifth and sixth formants are generally present, but tend to be more characteristic of individual voice quality than of a particular vowel sound. Harmonics are produced in human voices up to 4000 or 5000 Hz and, in some cases, even higher frequencies.

The vocal folds and much of the structure of the major sound resonating cavities are made of flexible tissue that are immediately responsive to muscular control. For example, the muscular control of the vocal folds and ligament tissue in cooperation with the mechanical linkage of bone and cartilage allows for a purposeful production of voiced sound and variation in voice pitch. Similarly, the muscles of the tongue and throat permit purposeful sound variation. Other cavities are similarly affected, but nasal and sinus cavities are affected to a more limited degree.

A. D. Bell, C. R. McQuiston and W. H. Ford designed instrumentation in the late 1960's and early 1970's intended to indicate emotional arousal or stress from voice. U.S. Pat. No. 3,971,034, ("Pat. '034") to Bell et al., teaches a method and apparatus for detecting psychological stress by evaluating manifestations of physiological change in the human voice. In Pat. '034, muscle microtremor causes a slight variation in vocal cord or fold tension resulting in shifts in a voice pitch. The oscillation or microtremor slightly varies the volumes and shapes of resonant cavities thereby frequency shifting the formant frequencies. These shifts around a central carrier frequency of the voiced sound constitute a frequency modulation of the central carrier frequency.

In Pat. '034, the microtremors have a physiological effect of very slightly modifying speech sounds to an extent corresponding to the magnitude of the movement caused by the microtremor. The microtremors occur at a maximum of approximately 8 to 12 Hz and are at maximum when the muscles are at a relatively relaxed state, such as during nonstressful conversational speech. The microtremors are very small and far below the typical fundamental frequency ranges of the human voice. The microtremors very slightly modify the tension of the vocal cords, tongue, lips, throat, etc., as well as the volumes and shapes of the corresponding resonating cavities during speech. This modification has the effect of modulating speech sound frequency at the changing frequency of the microtremor creating inaudible voice changes that the apparatus of Pat. '034 could detect.

In Pat. '034, the microtremors are suppressed under stress. The amplitude or extent of the microtremor is a function of psychological stress. The microtremors are at a maximum under normal states of relaxation and diminish under higher levels of stress in direct response to ANS influence. Thus, the frequency modulation is inversely proportional to the stress experienced by the speaker at the time of utterance.

Voice microtremor measurements are made electronically by a variety of voice stress analysis instruments. Dektor Counterintelligence and Security Company manufactured a psychological stress evaluator (PSE), which incorporates the apparatus of Pat. '034, to indicate psychological stress in speech sound. The electronic circuitry of the PSE records the utterances of voice and transduces the utterances using a microphone into electrical signals. The electrical signals are processed to emphasize selected characteristics of low frequency elements or representations of the recorded voice. The electronic circuitry of the PSE functions as a low frequency filter slowing down audio frequencies so that such audio frequencies match the fixed response range of the strip chart generator. The PSE is capable of processing speech samples of about one second or less.

The Computer Voice Stress Analyzer (CVSA) was introduced in 1988 by Computer Voice Stress Associates, the original manufacturer, and is currently manufactured by the National Institute for Truth Verification. The CVSA has some simplified operational features of the PSE and provides a more responsive strip chart apparatus than the PSE that is better matched in the range of frequency response with the recorded, filtered voice signals. The CVSA processes only very short speech samples and is used primarily for one word, e.g., "yes" or "no," answers used in deception detection protocols. However, CVSA and PSE generate "blocking" which is speculated to be an artifact of the match of the strip chart apparatus response range to the range of received electronically filtered voice signals. Blocking is also affected by the momentum of the heated stylus and friction on the strip chart.

Another voice stress analyzing instrument that has received some significant attention in both deception detection studies and a variety of other uses such as pre-employment tests, vocational assessment personality inventories and screening phone calls for alleged sexual abusers, is the Mark II Voice Analyzer. The Mark II electronically measures and counts spikes of roughness, or "tremolo", in electronically filtered speech instead of charting pattern changes as do the PSE and CVSA. The Mark II provides a numerical measure, i.e., a count of tremolo spikes, that is related to psychological stress. The Mark II was designed for analyzing brief speech samples obtained in deception detector protocols. However, all of the previously mentioned voice stress analyzers are capable of analyzing only very brief speech samples. Additionally, the previously mentioned voice stress analyzers provide analysis of voice stress in terms of deception detection protocols and do not analyze speech samples for biofeedback information.

What is needed is an improved method and apparatus to measure and analyze dynamic levels of psychological stress in people. In particular, what is needed is method and apparatus for detecting physiological indicators of psychological stress that can process long speech samples. Further needed is method and apparatus for detecting physiological indicators of psychological stress to provide biofeedback and allow voice stress research to go beyond typical deception detection protocols into wider use as a biofeedback instrument.

SUMMARY OF THE INVENTION

The present invention provides an improved method and apparatus to measure and analyze dynamic levels of psychological stress in people. In particular, the present invention provides method and apparatus for detecting physiological indicators of psychological stress that can process long speech samples. The present invention provides method and apparatus for detecting physiological indicators of psychological stress to provide biofeedback and allow voice stress research to go beyond typical deception detection protocols into wider use as a biofeedback instrument.

In its most basic form, the present invention is a speech analysis system for obtaining biofeedback information from human speech samples having variable duration. The speech analysis system comprises means for digitizing the human speech samples, storage means for receiving the digitized speech samples from the digitizing means and storing the digitized speech samples, processing means for detecting and analyzing counter homeostasis oscillation perturbation signals (CHOPS) in the digitized speech samples and display means for presenting the analyzed speech samples in a visual representation. The processing means is electrically connected to the storage means and the display means. The speech analysis system may further include transducer means electrically connected to the digitizing means and input means electrically connected to the processing means. The transducer means collects human speech samples having variable duration and transduces the speech samples into electrical signals. The transducer means is preferably a conventional microphone. The input means allows a system operator to configure the analysis parameters of the processing means, and the input means is preferably a keyboard. The present invention does not require any electrode or probe attachment from the speech analysis system to a subject.

In an alternative embodiment, the speech analysis system includes a recording means that is electrically connected to the digitizing means. The recording means temporarily stores the electrical signals corresponding to the human speech samples and may be a magnetic recording device such as an analog tape recorder. The recording means is particularly convenient when remotely collecting human speech samples for analysis by the speech analysis system at a later time.

The digitizing means includes a conventional analog-to-digital signal converter for converting the electrical signals corresponding to the human speech samples from an analog waveform to a digitized waveform, or digitized sound sample, having discrete sample segments. The storage means is a conventional internal or external memory storage device, for example, a secondary hard drive, direct access storage device (DASD), a magnetic tape storage device, an optical storage device or archived tape. The processing means may be a main frame computer, a minicomputer or a microprocessor. The processing means includes a speech amplitude discriminator, a speech amplitude variability discriminator and a speech frequency discriminator. The display means is a conventional monitor.

The method provides biofeedback from physiological indicators of stress using the previously mentioned speech analysis system. The method includes recording a human speech sample having variable duration with the transducer means, digitizing the human speech sample with the means for digitizing, storing the digitized speech sample in the storage means, determining CHOPS in the digitized speech sample with the processing means based on pre-determined parameters and identifying relationships between the CHOPS in the digitized speech sample with the processing means. The method may further include presenting the waveform of the digitized speech sample and CHOPS on the display and storing the CHOPS and the relationships between the CHOPS in the storage means.

The determining step includes producing a waveform having discrete sample segments corresponding to the digitized speech sample, detecting syllables in the digitized speech sample and determining a speech amplitude, a speech amplitude variability and a speech frequency of the digitized speech sample based on the detected syllables. The detecting step includes comparing the discrete sample segments to a threshold, identifying discrete sample segments that are above the threshold and filtering the digitized speech sample to isolate the discrete sample segments.

The present invention fulfills research and treatment needs of the psychological and medical communities for an accurate, valid and reliable physiological indicator of psychological distress that does not require physical connection to the measuring device. The present invention has applications for the research and treatment of medical and psychological disorders. The present invention can improve the quality of life by those wanting to reduce levels of psychological stress through biofeedback. The present invention is applicable to forensics or other applications where the level of psychological stress has relevant implications.

OBJECTS OF THE INVENTION

The principle object of the present invention is to provide an improved method and apparatus to measure and analyze dynamic levels of psychological stress in people.

Another object of the present invention is to provide method and apparatus for detecting physiological indicators of psychological stress that can process long and short speech samples.

Another object of the present invention is to provide method and apparatus for detecting physiological indicators of psychological stress to provide biofeedback and allow voice stress research to go beyond typical deception detection protocols into wider use as a biofeedback instrument.

Another, more particular, object of the present invention is to provide a system that can detect, store, sample, analyze and display counter homeostasis oscillation perturbation signals (CHOPS) found within the wave form of human speech.

Another object of the present invention is to provide a system that can detect, store, sample, analyze and display arousal in the autonomic nervous system or other biological processes.

Another object of the present invention is to provide a computer-based system that can detect, store, sample, analyze and display biofeedback previously unidentified by storing, sampling, analyzing and displaying stress in sound waves emitted from human speech.

Another object of the present invention is to provide a computer-based system that can detect, store, sample, analyze and display fully digitized speech samples of CHOPS.

Another object of the present invention is to provide a computer-based system that can detect, store, sample, analyze and display speech samples of CHOPS that may either be very short, such as a one word or syllable, or extremely long, ranging in duration from microseconds to minutes to hours.

Another object of the present invention is to provide a computer-based system that can detect at least three CHOPS currently identified as indicators of ANS arousal, particularly voice amplitude, voice amplitude variability and voice frequency for specific ranges of speech wave form.

Another object of the present invention is to provide a computer-based system that will not have a range of received electronically filtered voice signals affected by the momentum of a heated stylus and friction on a strip chart.

DESCRIPTION OF THE DRAWINGS

The foregoing and other objects will become more readily apparent by referring to the following detailed description and the appended drawings in which.

DETAILED DESCRIPTION

The present invention measures biofeedback signals that vary in relation to autonomic nervous system (ANS) arousal. The present invention detects and analyzes biofeedback signals by sampling, storing, analyzing and displaying indicators of stress found in sound waves emitted from human speech. More particular, the present invention detects and analyzes counter homeostasis oscillation perturbation signals (CHOPS). CHOPS are signals present within the wave form of human speech and include biofeedback signals found within speech samples. Unlike typical biofeedback techniques used to indicate states of ANS arousal and states of psychological distress or relaxation, the present invention detects and analyzes CHOPS without the intrusiveness of hard-wired signal detectors such as electrodes. Yet, like conventional biofeedback instrumentation, the present invention has many applications as an indicator of ANS arousal and psychological distress or relaxation. For example, the present invention has potentially therapeutic and clinical applications similar to instrumentation used for measuring skin conductance level or galvanic skin response, heart rate, hand temperature and electromyography (EMG).

CHOPS refers to an entire class of sound signals in human speech samples discovered by Dr. Robert MacCaughelty, Ph.D., since about 1989. The class consists of amplitude and frequency signals and variations in such signals. CHOPS include but are not limited to the three signals corresponding to speech amplitude, speech amplitude variability and speech frequency.

CHOPS are an additional class of psychophysiological indicators of ANS response, or arousal, and are a breakdown in the nonstressed organization of the wave form of speech. The neurological and physiological bases of CHOPS are logically related to one or more of the following:

1. direct sympathetic nervous system activation;
2. direct parasympathetic nervous system activation;
3. somatic neural projections into muscular and other soft tissues of voice mechanisms;
4. indirect neurological activations in the pyramidal and extrapyramidal efferent motor systems;
5. neuroendocrine responses;
6. inaudible voice microtremors; and
7. oscillations in the electrical recording of muscular activity at approximately 8 to 12 cycles per second.

Figure 1:
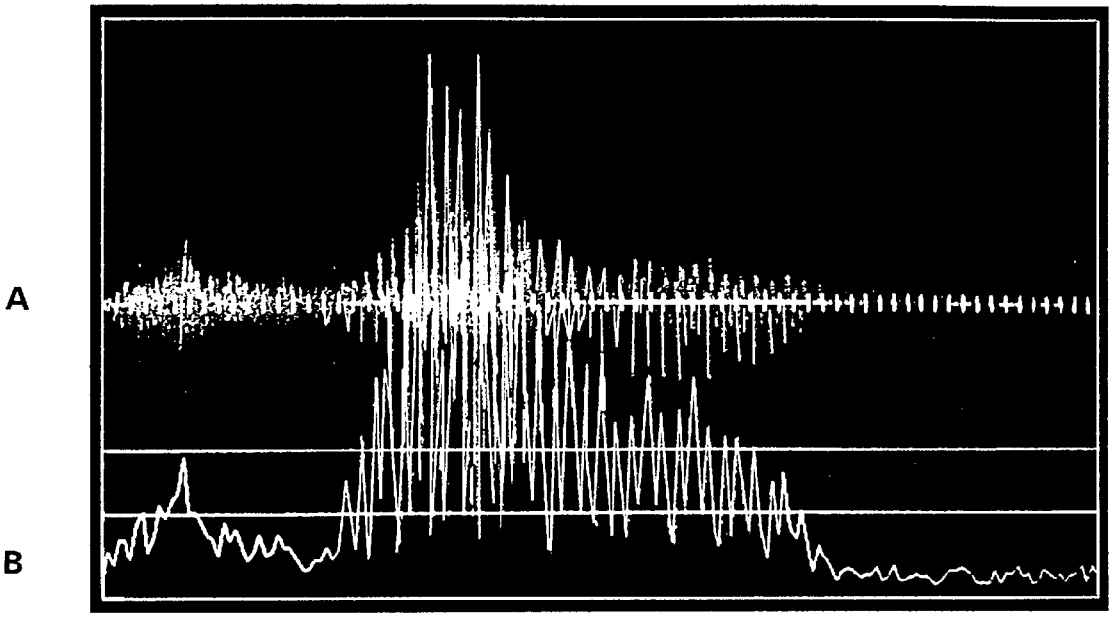
FIG. 1 is a graph depicting a human speech sample.

Referring now to the drawings, FIG. 1 is a graph depicting a human speech sample A in a raw digitized waveform representation and an analyzed representation B of the human speech sample superimposed onto the raw digitized waveform representation of the human speech sample A. The raw digitized waveform representation of the human speech sample A is digitized by the digitizing means, described in further detail hereinbelow. The digitized waveform representation of the human speech sample A is analyzed by a processing means, described in further detail hereinbelow, to produce the analyzed representation B of the human speech sample A. CHOPS voice stress analysis includes an analysis of low frequency variations in speech samples. As previously mentioned, the three CHOPS signals, speech amplitude, speech amplitude variability and speech frequency within specific ranges of a speech wave form, are indicators of ANS arousal. The present invention detects and analyzes the three CHOPS signals in the digitized speech sample A.

Figure 2:
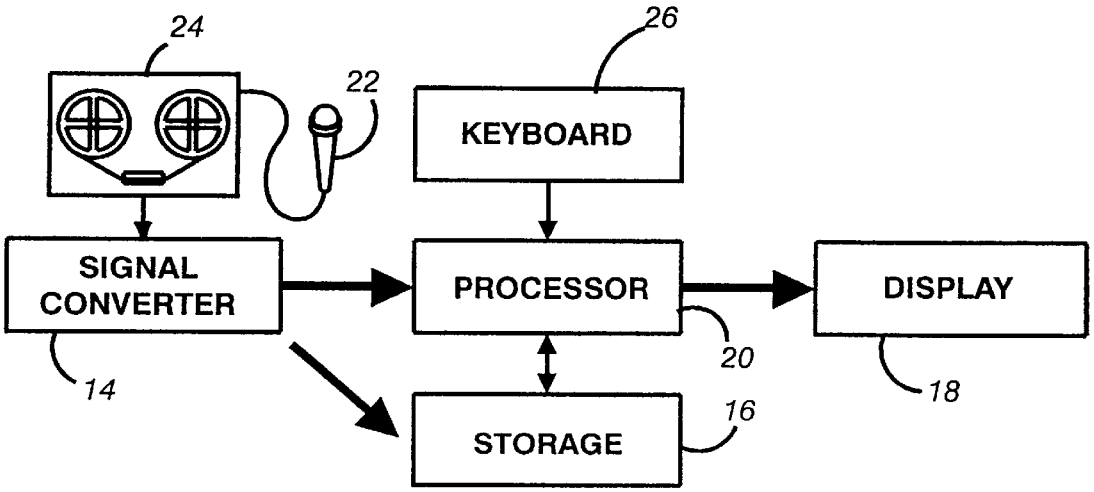
FIG. 2 is a schematic diagram of a counter homeostasis oscillation perturbation signal (CHOPS) detection system in accordance with the present invention.
Figure 3:
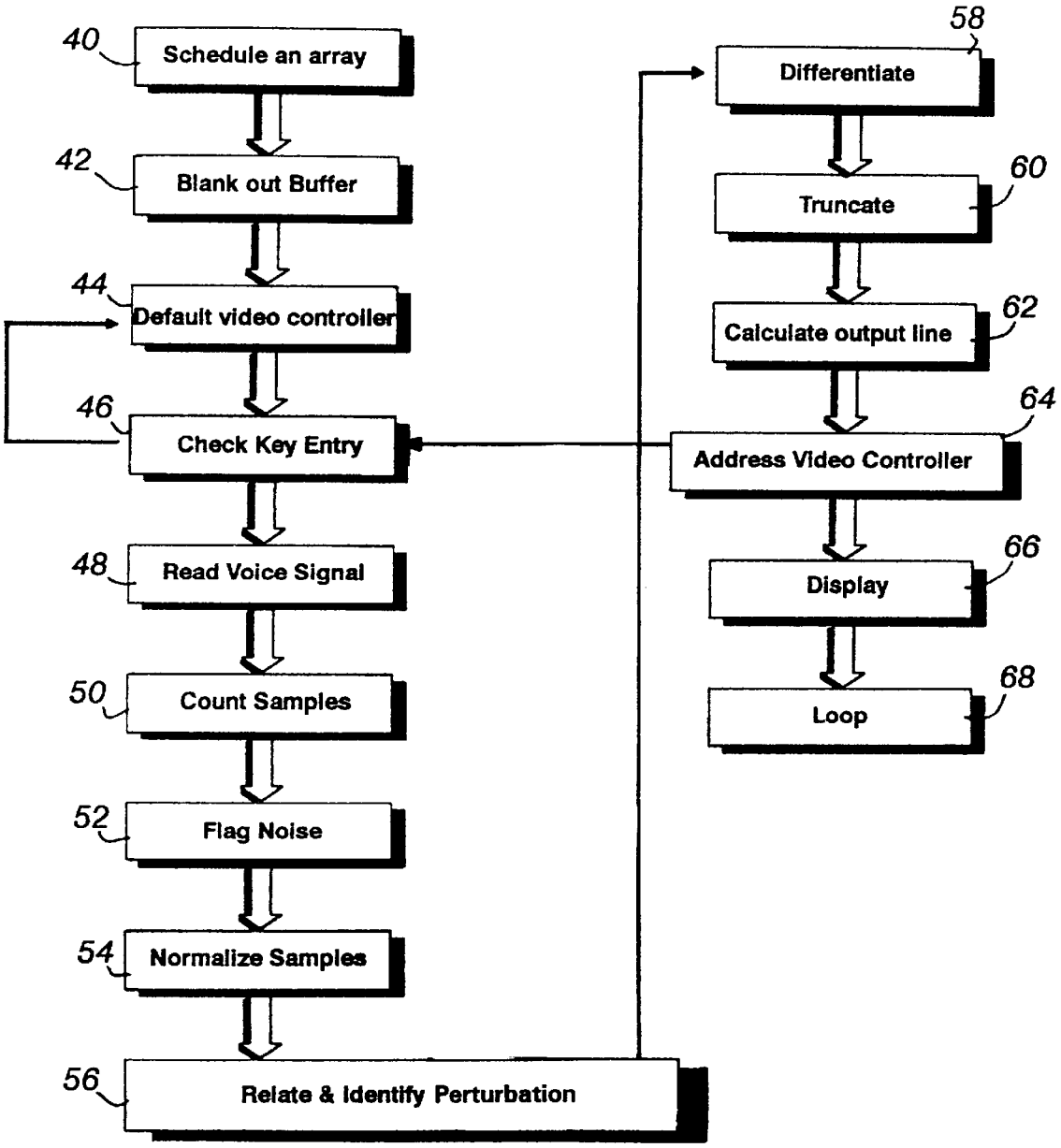
FIG. 3 is a flowchart illustrating the steps of an embodiment of the present invention.

FIG. 2 is a simplified plan view of a speech analysis system 10 in accordance with the present invention. In its most basic form, the speech analysis system 10 comprises means for digitizing 14 the human speech samples, storage means 16 for receiving the digitized speech samples from the digitizing means 14 and storing the digitized speech samples, processing means 20 for detecting and analyzing counter homeostasis oscillation perturbation signals (CHOPS) in the digitized speech samples and display means 18 for presenting the analyzed speech samples in a visual representation. The processing means 20 is electrically connected to the storage means 16 and the display means 18. The speech analysis system 10 does not require any electrode or probe attachment from the speech analysis system to a patient. No blocking effect, commonly generated by PSE and CVSA instrumentation, is found in the digitized speech samples analyzed by the speech analysis system 10. The present invention is not encumbered by the requirement of matching the range of received electronically filtered voice signals with the physical inertia of a moving stylus, or the resulting friction of the stylus against paper.

The speech analysis system 10 may further include transducer means 22 electrically connected to the digitizing means 14 and input means electrically connected to the processing means 20. The transducer means 22 collects human speech samples having variable duration and transduces the human speech samples to electrical signals. The transducer means 22 is preferably a conventional microphone. The input means 26 allows a system operator to configure the analysis parameters of the processing means 20. The input means 26 may include one or more user interface devices, such as a terminal including a keyboard and a mouse, that are electronically connected to the processing means 20. The input means 26 is preferably a keyboard.

The digitizing means 14 includes a conventional analog-to-digital signal converter that is preferably input compatible with the analog tape recorder. The digitizing means 14 converts the electrical signals corresponding to the human speech samples from an analog waveform to a digitized waveform, or digitized speech sample, having discrete sample segments. The digitizing means 14 is preferably capable of collecting about 8,000 discrete sample segments per second. For example, the digitizing means 14 may be a voice adapter card (such as a LANtastic® Voice Adapter manufactured by Artisoft, Inc.) that is adaptable to conventional computers in any free expansion slot and includes a microphone port. The present invention differs from previously available indicators of psychological stress in the voice by analyzing completely digitized speech samples.

The storage means 16 is a conventional internal or external memory storage device, for example, a secondary hard drive, direct access storage device (DASD), a magnetic tape storage device, an optical storage device or archived tape. The processing means 26 may be a main frame computer, a minicomputer or a microprocessor. The processing means 20 includes a speech amplitude discriminator (not shown), a speech amplitude variability discriminator (not shown) and a speech frequency discriminator (not shown) of the digitized speech sample. The speech amplitude discriminator determines the amplitude of the digitized speech sample for each sample segment by comparing the sample segment to a threshold. The threshold is a pre-determined level of speech amplitude for filtering background sound or noise. The speech amplitude discriminator identifies and filters the speech sample to isolate the sample segments that are above the threshold. The processing means detects syllables in the digitized speech sample based on the identification and isolation of pre-determined patterns of the sample segments that are above the threshold. For example, the processing means may initiate a tracking of a syllable based on the speech amplitude characteristics of a series of sample segments.

The speech amplitude variability discriminator determines the degree of variability among the amplitudes of sample segments of the digitized speech sample that are identified and isolated by the speech amplitude discriminator. Various conventional mathematical methods for determining variability in collected data may be applied by the speech amplitude variability discriminator. The speech frequency discriminator determines the frequencies of the digitized speech sample at pre-determined ranges of the digitized speech sample. The pre-determined ranges preferably correspond to the relative location of the detected syllables within the human speech sample. The processing means operating parameters include the previously mentioned threshold, constraints for identifying and isolating syllables and parameters for determining speech amplitude variability. The processing means operating parameters may be configured or modified by the system operator by inputting or "keying in" the operating parameters using the input means 26. By configuring or modifying the operating parameters of the processing means, the speech analysis system may be customized to analyze human speech samples in different environments.

The display means 18 is a conventional monitor and displays a raw waveform representation of the human speech sample, the digitized speech sample corresponding to the human speech sample and the speech amplitude, speech amplitude variability and speech frequency of pre-determined ranges of the human speech sample.

In an alternative embodiment, the speech analysis system includes a recording means 24 that is electrically connectable to the digitizing means 14. The recording means 24 temporarily stores the electrical signals corresponding to the human speech samples and is preferably an magnetic recording device such an analog tape recorder. The recording means is particularly convenient when collecting human speech samples at a remote location from the speech analysis system. For example, the collected human speech samples may be stored for a pre-determined time when a system user desires to analyze the collected speech samples.

In operation, the method provides biofeedback from physiological indicators of stress using the previously mentioned speech analysis system. The method includes transducing a human speech sample having variable duration into electrical signals with the transducer means, digitizing the human speech sample into a waveform having discrete sample segments with the means for digitizing, storing the digitized speech sample in the storage means, determining CHOPS in the digitized speech sample with the processing means based on pre-determined parameters and identifying relationships between the CHOPS in the digitized speech sample with the processing means. The method may further include presenting the waveform of the digitized speech sample and CHOPS on the display and storing the CHOPS and the relationships between the CHOPS in the storage means.

The determining step includes detecting syllables in the digitized speech sample and determining a speech amplitude, a speech amplitude variability and a speech frequency of the digitized speech sample based on the detected syllables. The detecting step includes comparing the discrete sample segments to a threshold, identifying discrete sample segments that are above the threshold and filtering the digitized speech sample to isolate the discrete sample segments.

The present invention analyzes both shorter samples, for example, syllables and short one word answers, and longer samples. For example, the speech analysis system can process longer samples having a duration in the range of at least about 10 seconds to minutes of human speech samples. The present invention breaks through many cumbersome data collection and scoring difficulties characteristic of conventional voice stress analyzers. The present invention also implements a system that detects, stores, samples, analyzes and displays ANS arousal or other biological processes including but not limited to direct sympathetic nervous system activation, direct parasympathetic nervous system activation, somatic neural projections into muscular and other soft tissues of voice mechanisms, indirect neurological activations in the pyramidal and extrapyramidal efferent motor systems, neuroendocrine responses, inaudible voice microtremors and oscillations in the electrical recording of muscular activity at approximately 8 to 12 cycles per second.

EXAMPLE 1

In a cold pressor task, a study of 91 males between the ages of 18 and 55 was conducted and included a 75 second cold pressor task. Pre and cold pressor task heart rate (HR), HR variability, skin conductance level (SCL), SCL variability, and four CHOPS measures (voice amplitude, voice amplitude variability, voice frequency baseline and voice frequency cold pressor task) were made as dependent variables. Additionally, pre and post self-report measure were also gathered.

The cold pressor task is a frequently used aversive stimulation for psychological stress and/or pain induction. Pain or thoughts about pain are correlated with increases in ANS arousal through such physiological indicators as increases in heart rate and skin conductance. The procedure generally includes immersing the hand or foot up to the wrist or ankle in ice cold water with the ice kept separated from the subject through the use of a screening device. Generally, enough ice and plain water is used such that the temperature of the water is maintained at about 0 to about 5 degrees Centigrade. Standardization of beginning limb temperature is usually achieved by immersion in a warm water bath at 37 degrees Centigrade for about two minutes. The hand or foot is then immediately immersed in the cold water.

The usual phenomenological course of sensation produced by the cold pressor task includes a diffuse, dull aching pain beginning at about 10 to about 15 seconds. This diffuse pain increases rapidly for about 30 to about 40 seconds. Major physiological reactions occur during this rapid increase, for example, heart rate and skin conductance levels increase to their maximum. The pain, however, continues to increase, generally reaching a maximum intensity at about 60 seconds after initiation of the cold pressor task but may be reached before such time. Following the maximum intensity, the pain intensity generally slowly subsides as do many physiological reactions. Between about one and about two minutes after immersion, a mild tingling appears along with the aching pain.

Paired "t" tests of dependent variables for all 91 subjects ("$S_s$") taken as a whole showed significant ($p<0.001$) differences in HR, HR variability, SCL, SCL variability, SCL reading and self-report pre and post test distress. This demonstrates that the cold pressor task robustly created ANS arousal.

Using recorded human speech samples, paired "t" tests of voice related dependent variables for all 91 $S_s$ taken as a whole showed significant differences in voice amplitude, voice amplitude variability and voice frequency between baseline and cold pressor task ($p<0.001$). This demonstrates the presence and detection of CHOPS in the human speech samples and also indicates ANS arousal.

EXAMPLE 2

The speech analysis system implements and operates an algorithm. Although the algorithm is described in terms of a DOS system, the algorithm may be implemented on various operating systems, including WINDOWS® based systems. The algorithm is described in terms of a DOS system merely for convenience of description and explanation and is not intended to be limited to DOS applications.

In the algorithm, the system schedules an analysis of the digitized speech samples in step 40 via interaction with a set of perturbation banks housed in at least one set of data arrays. For example, file specifications contained within arrays 1 through n in the storage means are scanned by the processing means to store the relevant data when addressed by a system operator. The data is then sampled and stored or immediately analyzed depending upon the state of the processing means. For example, if the processing means is a minicomputer, the state of the interrupt controller determines whether the data is sampled and stored or immediately analyzed.

In step 42, the system obtains commands using an input buffer for establishing extrinsic command protocol and subsequently blanks out the buffer. For example, the system transfers extrinsic commands to an executed copy of a command routine, for example "command.com". The system then sets default variables in step 44 for interaction with a video controller and checks for key entry video overrides in step 46. The system reads a human speech sample or voice signal in step 48. Depending on the particular key entry video override, the system may repeat step 44 until no further overrides are detected.

The system then counts the syllables in the sample in step 50, flags noise in the samples in step 52, normalizes the samples in step 54, determines relevant perturbation patterns of the syllables from at least one array and identifies the relationships between the perturbation patterns in step 56. The system differentiates the amplitude count between the normalized syllables in step 58, truncates the amplitudes of the human speech sample in step 60 when end detection is not reached, calculates an output line corresponding to the human speech sample and stores the output line in a line register in step 62. The system addresses a video controller object to the line register in step 64, checks for keyboard entry overrides 46 and displays the human speech sample output line in step 66. In step 68, the system repeats or loops the steps 40 through 66 until analysis of the human speech sample is completed.

SUMMARY OF THE ACHIEVEMENT OF THE OBJECTS OF THE INVENTION

From the foregoing, it is readily apparent that I have invented an improved method and apparatus to measure and analyze dynamic levels of psychological stress in people. The present invention provides method and apparatus for detecting physiological indicators of psychological stress that can process long and short speech samples. The present invention provides method and apparatus for detecting physiological indicators of psychological stress to provide biofeedback and allow voice stress research to go beyond typical deception detection protocols into wider use as a biofeedback instrument. The present invention provides a system that can detect, store, sample, analyze and display counter homeostasis oscillation perturbation signals (CHOPS) found within the wave form of human speech. The present invention implements a system that can detect, store, sample, analyze and display arousal in the autonomic nervous system or other biological processes. The present invention provides a computer-based system that can detect, store, sample, analyze and display biofeedback previously unidentified by storing, sampling, analyzing and displaying stress in sound waves emitted from human speech. The present invention provides a computer-based system that can detect, store, sample, analyze and display fully digitized speech samples of CHOPS. The present invention provides a computer-based system that can detect, store, sample, analyze and display speech samples of CHOPS that may either be very short, such as a one word or syllable, or extremely long, ranging in duration from microseconds to minutes to hours. The present invention provides a computer-based system that can detect at least three CHOPS currently identified as indicators of ANS arousal, particularly voice amplitude, voice amplitude variability and voice frequency for specific ranges of speech wave form. The present invention provides a computer-based system that will not have a range of received electronically filtered voice signals affected by the momentum of a heated stylus and friction on a strip chart.

It is to be understood that the foregoing description and specific embodiments are merely illustrative of the best mode of the invention and the principles thereof, and that various modifications and additions may be made to the apparatus by those skilled in the art, without departing from the spirit and scope of the invention, which is therefore understood to be limited only by the scope of the appended claims.

What is claimed is:

1. A speech analysis system for obtaining biofeedback information from human speech samples having variable duration and for identifying counter homeostasis oscillation perturbation signals (CHOPS) in the human speech samples, the system comprising:

means for digitizing the human speech samples into discrete sample segments electrically connected to said recording means;

storage means for receiving the digitized speech samples from the means for digitizing and storing the digitized speech samples;

processing means for detecting and analyzing CHOPS in the digitized speech samples, said processing means electrically connected to said storage means; and display means for presenting the analyzed speech samples in a visual representation, said display means electrically connected to said processing means.

2. A speech analysis system according to claim 1 further comprising:

transducer means for collecting the human speech samples, said transducer means electrically connected to said means for digitizing.

3. A speech analysis system according to claim 2 further comprising:

recording means for receiving the human speech samples from said transducer means and temporarily storing the human speech samples, said recording means electrically connectable to said transducer means.

4. A speech analysis system according to claim 1 further comprising:

input means for configuring the parameters of said processing means, said input means electrically connected to said processing means.

5. A speech analysis system according to claim 1 wherein said processing means comprises:

a speech amplitude discriminator for determining the amplitude of the sample segments of the digitized speech sample;

a speech amplitude variability discriminator for determining the degree of variability between the amplitudes of the sample segments of the digitized speech sample; and a speech frequency discriminator for determining frequencies for pre-determined ranges of the digitized speech sample.

6. A counter homeostasis oscillation perturbation signals (CHOPS) analyzer for obtaining physiological indicators of stress from human speech samples having variable duration, the analyzer comprising:

a digitizer electrically connected to said magnetic recorder for converting the human speech samples to digitized speech samples;

storage means for receiving the digitized speech samples from the digitizer and electrically storing the digitized speech samples;

a processor for detecting and analyzing CHOPS in the digitized speech samples; and a display for presenting the analyzed speech samples in a visual representation, said display electrically connected to said processor.

7. A CHOPS analyzer according to claim 6 further comprising:

a microphone for collecting the human speech samples.

8. A CHOPS analyzer according to claim 7 further comprising:

a magnetic recorder electrically connected to said microphone for receiving the human speech samples from said microphone and temporarily storing the human speech samples.

9. A CHOPS analyzer according to claim 6 further comprising:

an input terminal for configuring the parameters of said processor, said input terminal electrically connected to said processor.

10. A method of providing biofeedback from physiological indicators of stress in a speech analysis system having a transducer means, a means for digitizing, a storage means, a processing means and a display, the method comprising the steps of:

transducing a human speech sample having variable duration into electrical signals with the transducer means;

digitizing the human speech sample into a waveform having discrete sample segments with the means for digitizing;

storing the digitized speech sample in the storage means;

determining the counter homeostasis oscillation perturbation signals (CHOPS) in the digitized speech sample with the processing means, said step of determining CHOPS based on pre-determined parameters; and identifying relationships between the CHOPS in the digitized speech sample with the processing means.

11. A method of providing biofeedback according to claim 10 further comprising the step of:

presenting the waveform of the digitized speech sample and CHOPS on the display.

12. A method of providing biofeedback according to claim 10 further comprising the step of:

storing the CHOPS and the relationships between the CHOPS in the storage means.

13. A method of providing biofeedback according to claim 10 wherein the step of determining comprises the steps of:

detecting syllables in the digitized speech sample; and determining a speech amplitude, a speech amplitude variability and a speech frequency of the digitized speech sample based on the detected syllables.

14. A method of providing biofeedback according to claim 13 wherein the step of detecting comprises the steps of:

comparing the discrete sample segments to a threshold;

identifying discrete sample segments that are above the threshold; and filtering the digitized speech sample to isolate the discrete sample segments.

* * * * *